US006547155B2

(12) United States Patent
Crane

(10) Patent No.: US 6,547,155 B2
(45) Date of Patent: Apr. 15, 2003

(54) COOLANT NOZZLE

(75) Inventor: G. Keith Crane, The Woodlands, TX (US)

(73) Assignee: Rigaku/MSC, Inc., The Woodlands, TX (US)

( * ) Notice: Subject to any disclaimer, the term of this patent is extended or adjusted under 35 U.S.C. 154(b) by 75 days.

(21) Appl. No.: 09/793,300

(22) Filed: Feb. 26, 2001

(65) Prior Publication Data

US 2002/0117553 A1 Aug. 29, 2002

(51) Int. Cl.[7] ..... B05B 1/24
(52) U.S. Cl. ..... 239/13; 239/135

(58) Field of Search ..... 239/13, 128, 133, 239/135, 139; 62/51.1, 55.5

(56) References Cited

U.S. PATENT DOCUMENTS 3,718,805 A * 2/1973 Posey ..... 222/146.5
5,653,113 A * 8/1997 Sawano ..... 62/51.1

* cited by examiner

*Primary Examiner*—Lisa A. Douglas
(74) *Attorney, Agent, or Firm*—R. Perry McConnell

(57) ABSTRACT

A cold-gas coolant nozzle which limits the amount of turbulence induced in the flow of cold gas due to interaction with ambient air by creating a intermediate temperature buffer zone between the cold gas and the ambient air.

16 Claims, 7 Drawing Sheets

--Prior Art--

--Prior Art--

COOLANT NOZZLE

TECHNICAL FIELD

The invention concerns a nozzle for delivering low temperature coolant to a position within a room-temperature atmosphere with improved flow characteristics.

BACKGROUND OF THE INVENTION

X-ray crystallography is typically performed by diffracting x-rays through a crystalline sample and determining the resultant pattern of diffracted radiation on a detector or target. In many applications, the sample must be frozen prior to and during testing to maintain the crystal structure of the sample. In such cases, the need to maintain the crystal in a frozen state is complicated by the continual influx of x-ray energy, part of which is absorbed by the sample. As the sample absorbs energy, it heats, and such heating must be offset by a cooling mechanism if the sample is to be retained in a frozen state. Further, because additional testing of samples after an initial x-ray diffraction test is often desirable, it is often necessary to be able to insure the frozen state, and thereby the integrity, of a sample throughout the x-ray crystallography process and afterward.

One of the mechanisms for maintaining a sample in a frozen state is to provide a steady coolant stream to the sample's location. Very cold nitrogen gas is often used as the coolant stream because nitrogen is readily available, techniques for refrigerating it are well known, and it does not introduce environmental hazards into the working area. However, a variety of other gases, including helium and other noble gases, can readily be used to provide such a coolant stream.

The x-ray crystallography process is normally carried out inside of an ambient, e.g. room-temperature, environment, so that when crystals undergoing crystallography must be maintained at a specialized temperature, such as approximately −180° C., a specially controlled temperature zone must be created. Further, the physical requirements of the x-ray crystallography process require open space around the sample, so that the apparatus directing the coolant stream cannot be placed in immediate proximity to the sample. Generally, the coolant stream which creates the special temperature zone for the crystals is directed by a nozzle which is preferably spaced apart from the sample so that the nozzle does not interfere with the x-rays incident to the sample or diffracted therefrom, and so that the nozzle does not interfere with the necessary movements of other apparatus. The nozzle generally comprises a vacuum jacket to insulate the coolant stream from the ambient atmosphere until the coolant stream exits the nozzle.

To provide maximum cooling of the sample and to avoid icing on the sample, it is desirable that the coolant stream be dry and that it flow smoothly. However, the physical circumstances described above hinder these goals. Even if the coolant stream leaves the nozzle in a laminar flow state, the outer zone of the coolant stream is rapidly heated by contact with the much warmer ambient atmosphere. As it heats, the coolant stream gas expands, and may do so unevenly, introducing turbulence into the coolant stream flow. The flow may be further disrupted by normal air currents in the room. Further, even if the coolant stream gas is dry when it exits the nozzle, the induced turbulence and mixing with moisture in the room air may create icing problems at the sample.

The greater the distance between the nozzle and the sample, the more time these effects have to disrupt the flow of the coolant stream. Thus, even though it is desirable to move the nozzle out of the way of the x-ray crystallography equipment and the x-rays themselves, it is sometimes impossible to achieve these goals, and the testing equipment must instead be adjusted to accommodate the cold stream nozzle.

To offset the disruption of the coolant stream caused by this rapid heating on contact with the ambient atmosphere, it is possible to pre-warm the outer zone of the coolant stream just after it exits the nozzle. Generally, this pre-warming is accomplished by fitting a hollow cylindrical heating element to the exit port of the nozzle. The internal diameter of the heating element is essentially the same diameter as the exit port, and thus of the coolant stream. By controlling the electrical current in the heating element, the outer zone of the coolant stream can be heated to a desired temperature as the coolant stream passes through the heating element. Generally, the outer zone of the coolant stream will be warmed to a temperature intermediate that of the ambient atmosphere and the inner zone of the coolant stream. Thus, the warmed outer zone of the coolant stream provides a buffer between the ambient atmosphere and the colder inner zone of the coolant stream.

Although such a heating element improves the distance over which laminar flow of the coolant stream can be achieved, there remain undesirable effects which limit its utility. The addition of an extension to the nozzle introduces a discontinuity in the flow containment which can disrupt the laminar nature of the coolant stream flow. Additionally, the heating elements used are omnidirectional, that is, they radiate heat outward into the ambient atmosphere as well as inward into the coolant stream. Because warming the outer zone of the coolant stream requires a significant amount of heat, the heating element presents a safety hazard to personnel working around the nozzle.

It is an object of this invention to provide a coolant stream nozzle with improved flow characteristics for the coolant stream after it exits the nozzle.

It is a further object of this invention to provide a coolant stream nozzle which allows greater separation distance between the nozzle and the sample being maintained in the coolant stream.

It is another object of this invention to provide a coolant stream nozzle which provides a coolant stream which limits icing of the sample being maintained in the coolant stream.

BRIEF DISCLOSURE OF THE INVENTION

A coolant stream nozzle is provided which allows the outer zone of the coolant stream to be warmed inside the nozzle. The nozzle comprises a tubular cavity which guides the coolant stream within the nozzle, and an outlet from which the coolant stream exits the nozzle. The tubular cavity is enclosed in a vacuum jacket which insulates the tubular cavity, and thus the coolant stream, from the ambient atmosphere. Inside the vacuum jacket, an electrical heater is wound around the portion of the tubular cavity which is essentially adjacent the outlet. In the preferred embodiment, the outer surface of the tubular cavity comprises a scalloped heater seat which allows maximizes the physical contact between the electrical heater and the tubular cavity. The scalloped heater seat provides a continuous, threaded groove into which the heater is seated.

Also in the preferred embodiment, the electrical heater comprises an active heater wire and a heater lead wire, wherein the heater lead wire provides an electrical connection to the active heater wire, but does not itself produce significant heat. As those of skill in the art will recognize, it is desirable to have the heater as close to the end of the tubular cavity adjacent the orifice as possible, and also to have the heating effect on the coolant stream restricted to the linear length of the heater. Because the heater lead wire does not produce significant heat, it may be extended within the vacuum jacket to a convenient feed-through or connection point without producing undesired heating effects on the coolant stream.

An additional aspect of the preferred embodiment is to provide a flared portion of the tubular cavity essentially adjacent the outlet. It is preferred that the active heater wire is in contact with the tubular cavity for the length of the flared portion of the tubular cavity. Thus, the heater will provide heat to the coolant stream in a zone where the gas in the outer zone of the coolant stream will have room to expand as it is heated. Allowing this expansion to occur in the same area in which the heat is applied to the coolant stream and while the coolant stream is still enclosed by the flared portion of the tubular cavity helps to limit turbulence and maintains the laminar nature of the coolant stream flow.

DESCRIPTION OF THE PREFERRED EMBODIMENT

Figure 2:
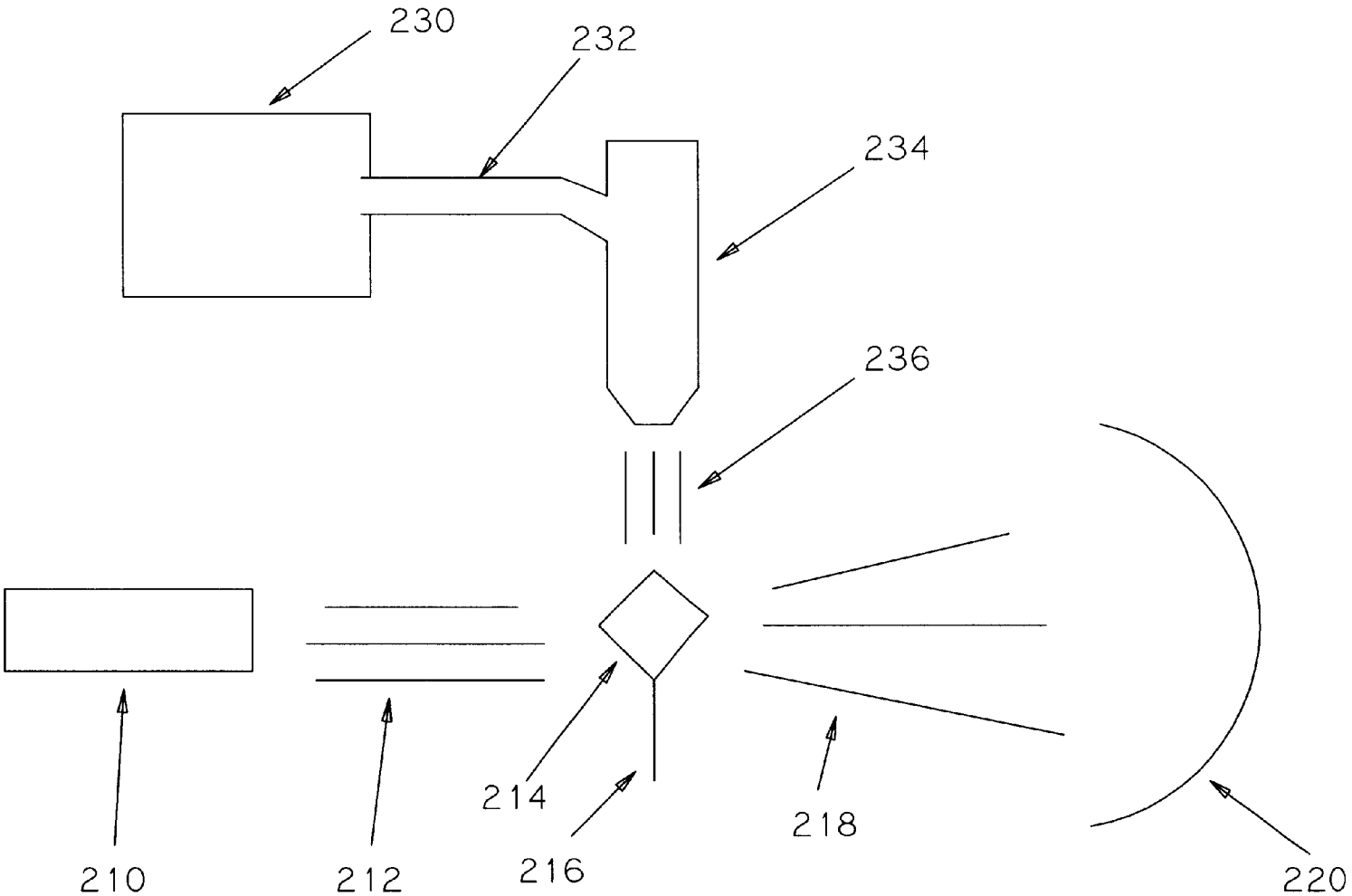
FIG. 2 is a schematic representation of one embodiment of an x-ray crystallography system.

Referring to FIG. 2, one embodiment of an x-ray crystallography system is shown to illustrate the use of the coolant stream. In x-ray crystallography, an x-ray source 210 produces an x-ray beam 212 which impinges on a sample 214 mounted on a sample holder 216. Diffraction of the x-rays beam 212 by the sample 214 results in a diffracted x-ray beam 218 which impinges on a detector 220 for measurement and analysis. Because data must generally be collected over a large angular swath, one or more of the x-ray source 210, the sample holder 216, or the detector 220 is usually repositionable, and such repositioning is often done under automatic control. During the course of performing x-ray crystallography, it is also important that the x-ray beam 212 and the diffracted x-ray beam 218 be unobstructed. Further, it is also necessary to be able to remove or replace the sample 214 when an x-ray crystallography test is complete.

During x-ray crystallography, the sample 214 will be subject to heating by the incident x-ray beam 212. If the sample 214 is frozen to maintain its crystal structure, this heating must be offset to prevent the sample from thawing. Further, the sample is subject to heating from the ambient atmosphere in the room. One means of offsetting the heating is to provide a coolant source 230 such as a source of extremely cold nitrogen gas, although those of skill in the art will recognize that other coolants than nitrogen gas are usable in this situation. The coolant source 230 is connected via a coolant transport tube 232 to a nozzle 234, which then directs a coolant stream 236 over the sample.

However, the coolant stream 236 must maintain essentially laminar flow over the distance between the nozzle 234 outlet and the sample 214. Once turbulence is introduced, the coolant stream 236 begins mixing with the ambient atmosphere, the coolant stream 236 heats rapidly, losing its cooling capacity. Further, the introduction of additional moisture from the ambient atmosphere can result in icing on the sample or the sample holder and disruption of the x-ray crystallography measurement. Because the ambient atmosphere is inherently in motion and non-laminar, such mixing between the coolant stream 236 and the ambient atmosphere will always occur.

Such problems might be avoidable if the nozzle 234 could always be positioned so that the coolant stream 236 exited the nozzle 234 almost immediately adjacent the sample 214, and there were essentially no spatial transit required before the coolant stream 236 reached the sample 214. However, such a placement of the nozzle 234 would interfere with the need to reposition the x-ray source 210, sample 214, or detector 220, and would also obstruct the x-ray beam 218 or the diffracted x-ray beam 218.

Figure 4:
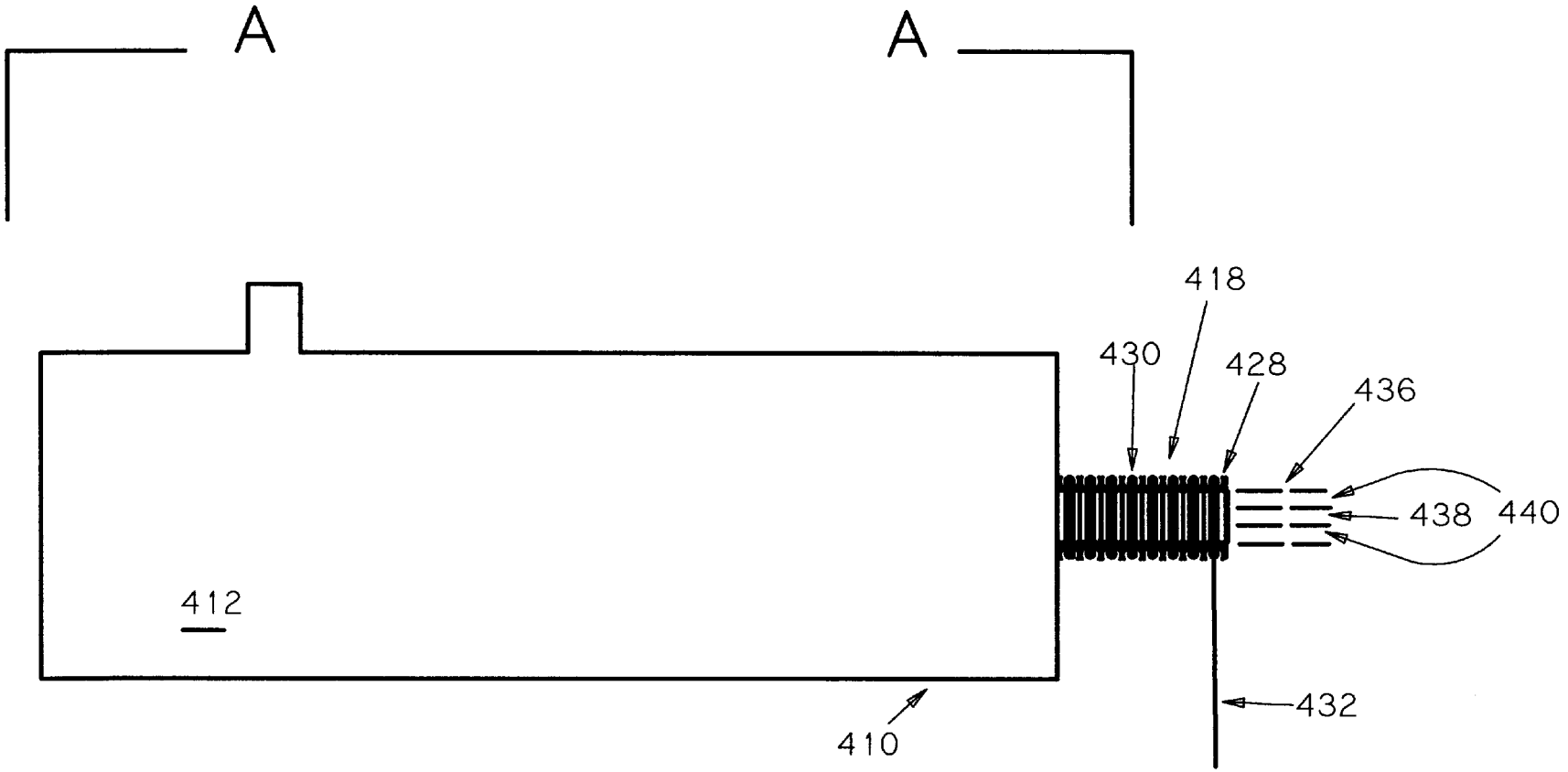
FIG. 4 is a side view of a prior-art coolant stream nozzle.
Figure 4A:
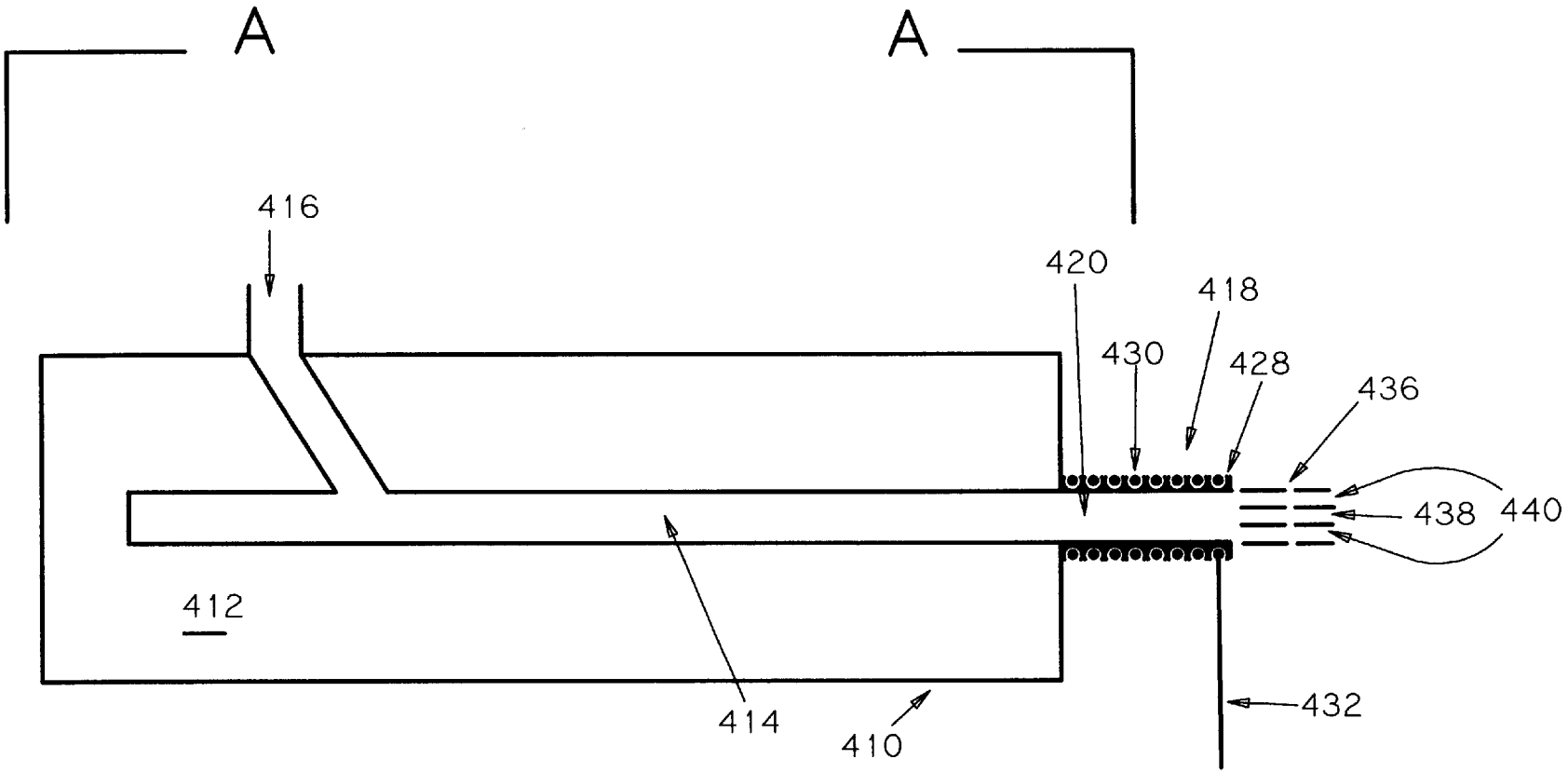
FIG. 4A is a cross-sectional view of the coolant stream nozzle of FIG. 4, sectioned along plane A—A of FIG. 4.

Referring to FIGS. 4 and 4A, one prior art nozzle 410 for extending the distance over which laminar flow can be maintained in the coolant stream 436 is shown. The nozzle 410 comprises a tubular cavity 414, which guides the coolant stream 436 through the nozzle 410 and insures that the coolant stream 436 is in a laminar flow state which it exits the nozzle 410. The tubular cavity 414 is enclosed in a vacuum jacket 412 which insulates the tubular cavity 414 from the ambient atmosphere (not shown). The coolant stream enters the tubular cavity through an inlet 416. As the coolant stream 436 exits the nozzle 410, it flows though an extender 418. The extender 418 comprises and inner tubular section 420 of essentially the same diameter as the tubular cavity 414, and a scalloped heater seat 428, which allows a heater 430 to be threaded around and seated onto the extender 418. The scalloped heater seat 428 allows maximum thermal contact between the heater 430 and the extender 418. The heater 430 is electrically connected to a power source (not shown) by means of a connecting lead 432.

In use, sufficient current is applied through the heater 430 so that, as the coolant stream 436 exits the extender 418, the coolant stream 436 comprises a relatively warm outer zone 440 and a very cold inner zone 438. The relatively warm outer zone 440 of the coolant stream has a temperature intermediate that of the ambient atmosphere and the very cold inner zone 438, and thus serves as a buffer zone between the ambient atmosphere and the very cold inner zone 438. The existence of the relatively warm outer zone 440 extends the distance over which the coolant stream 436 can maintain its laminar characteristics. However, the heated gas in the relatively warm outer zone 440 of the coolant stream 436 quickly expands, which it is unable to do in the extender 418. Thus, some of the benefits of the relatively warm outer zone 440 are lost as its expansion induces mixing with the ambient atmosphere. Further loses in laminar characteristics in the coolant stream 436 can result from discontinuities between the tubular cavity 414 and the extender 418. An additional disadvantage to this device results from the high heat created at the heater 430, which presents a safety hazard to personnel working around the device.

Figure 1:
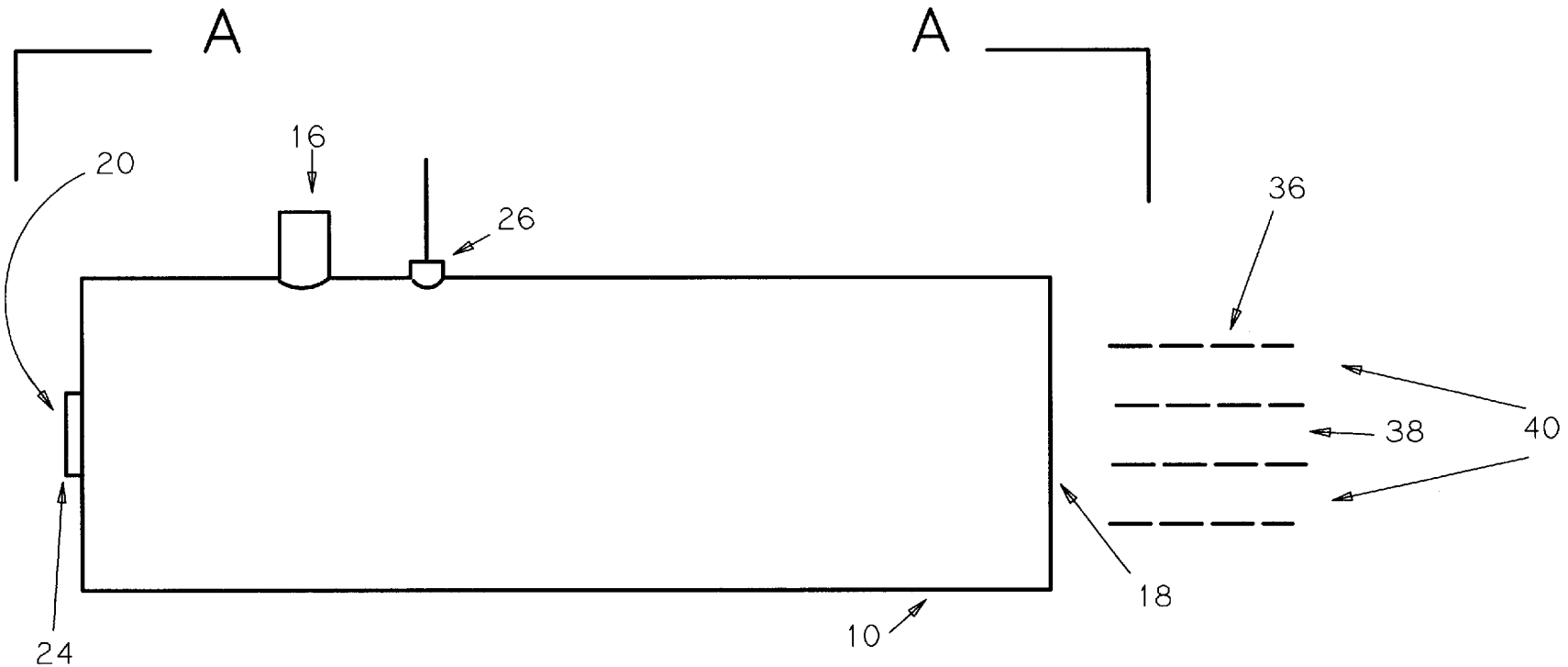
FIG. 1 is a side view of one embodiment of a coolant stream nozzle.
Figure 1A:
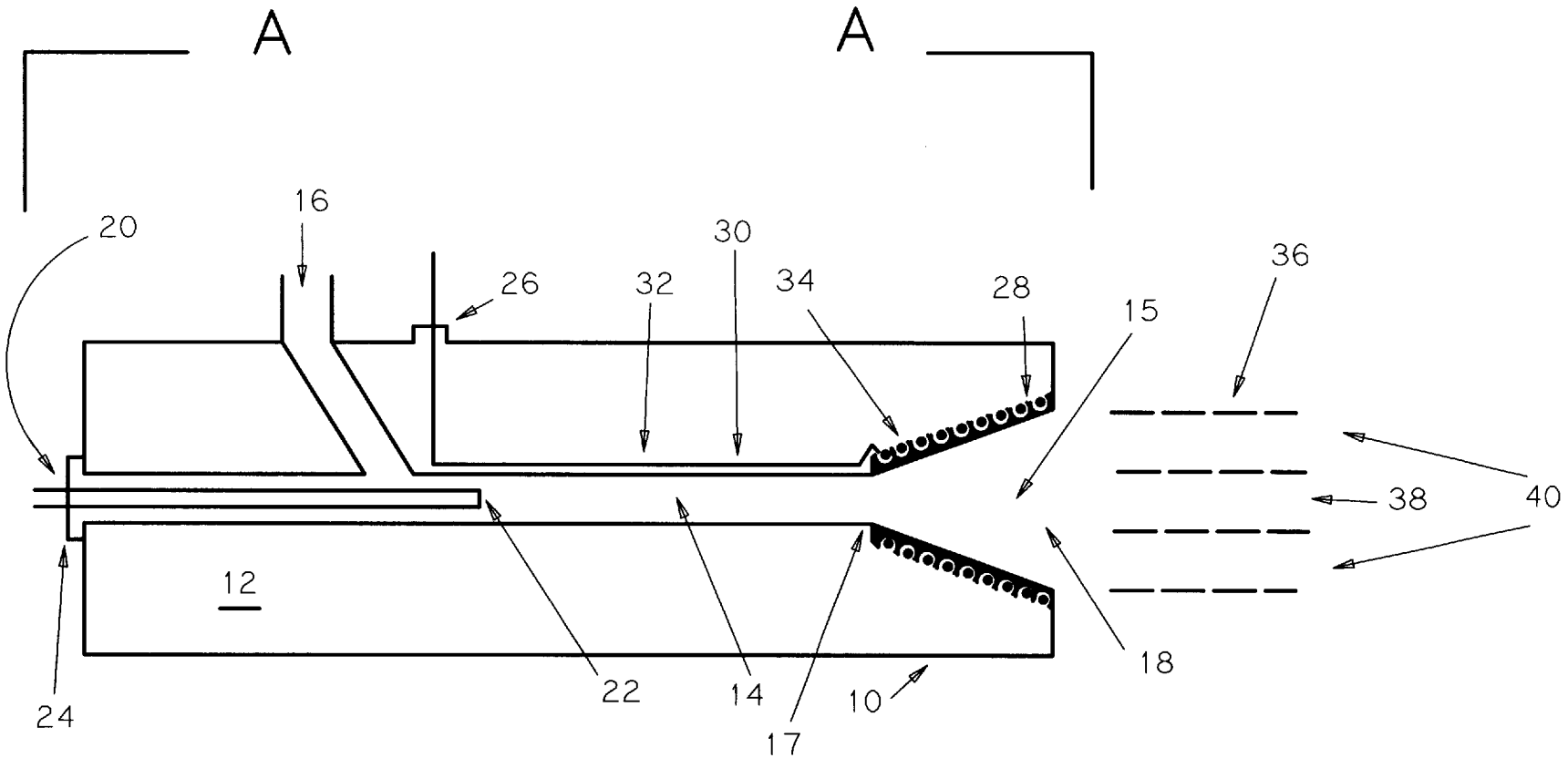
FIG. 1A is a cross-sectional view of the coolant stream nozzle of FIG. 1, sectioned along plane A—A of FIG. 1.
Figure 1B:
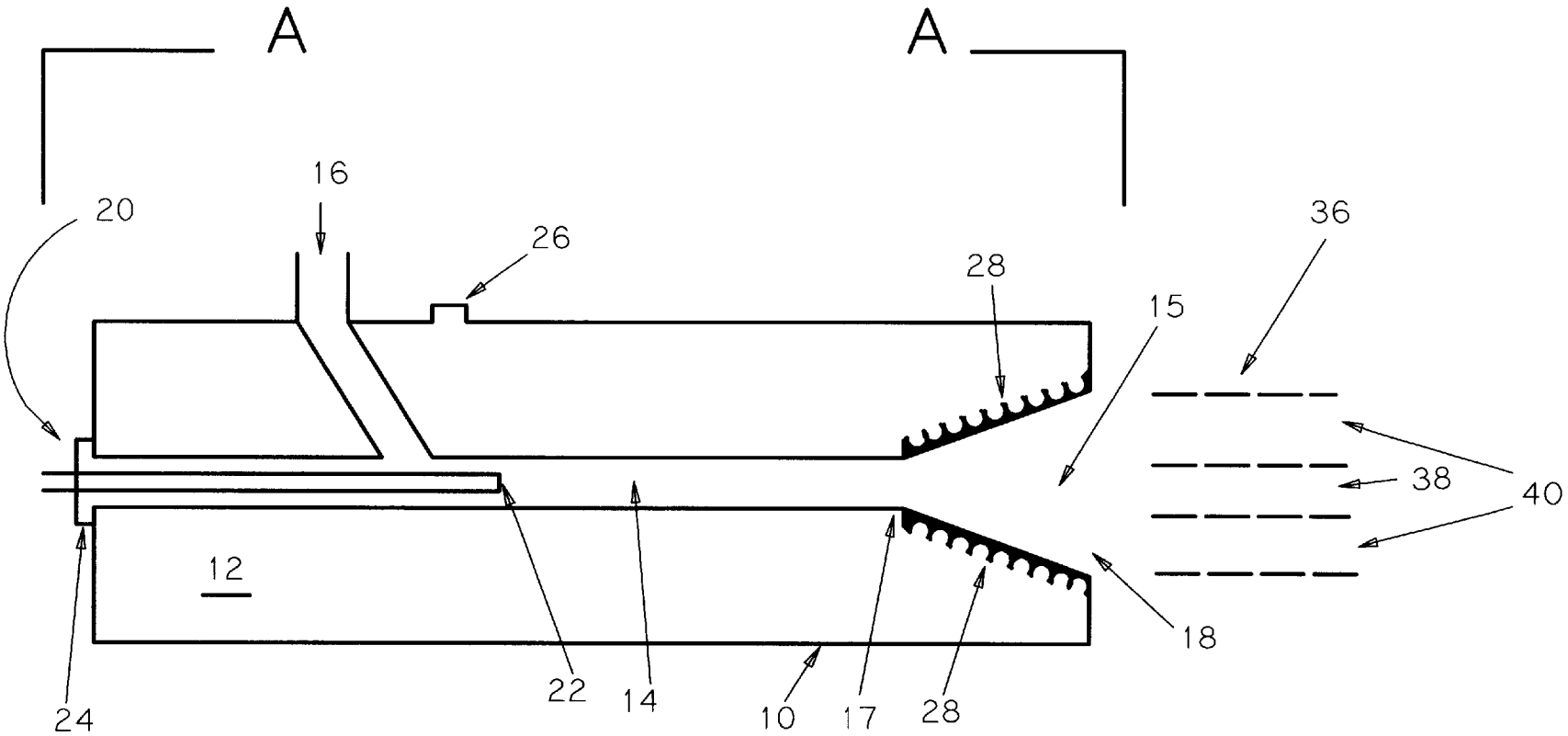
FIG. 1B is a cross-sectional view of the coolant stream nozzle of FIG. 1, sectioned along plane A—A of FIG. 1, with the heater elements omitted for clarity.

Referring to FIGS. 1, 1A, and 1B, an embodiment of the present invention is shown. A nozzle 10 comprises an essentially cylindrical vacuum jacket 12 and a tubular cavity 14. Although not required, the tubular cavity may extend longitudinally down the entire nozzle 10 to provide an orifice 20, into which a measuring device, such as a thermocouple 22 may be inserted. In such cases, a seal 24 is provided to close the orifice 20 and prevent loss of material from the coolant stream 36 through the orifice 20.

The tubular cavity also comprises an inlet 16 and an outlet 18, through which the coolant stream 36 enters and exits, respectively, the tubular cavity 14. In the preferred embodiment, the tubular cavity also comprises a flared portion 15 in the section of the tubular cavity 14 adjacent the orifice 18. The outer surface 17 of the tubular cavity 14 comprises a scalloped heater seat 28, which provides a continuous groove into which a heater 30 may be threaded and seated. The scalloped form of the scalloped heater seat 28 allows the heater 30 to be placed in maximum physical contact with the tubular cavity 14 to maximize the heat transfer from the heater 30 to the tubular cavity 14.

The heater 30 comprises an active heater element 34 and a heater lead wire 32. The heater lead wire 32 provides an electrical connection to the active heater element 34, but does not itself produce significant heat while carrying current. This feature allows the heater lead wire 32 to be extended within the vacuum jacket to a convenient location where it can be connected to an external power source (not shown) via a vacuum feed through 26. Because the heater lead wire 32 does not produce significant heat, it does not adversely affect the conditions of the coolant stream 36 within the tubular cavity 14.

With the heater 30 turned on, the coolant stream 36 is heated in the region near the outlet 18, resulting in the coolant stream having an essentially hollow cylindrical, relatively warm outer zone 40 and an essentially cylindrical very cold inner zone 38. The flare 15 in the tubular cavity 14 allows the relatively warm outer zone 40 to expand as it is being heated, thereby maintaining the laminar characteristics of the coolant stream 36 during the heating process. By heating the outer zone of the coolant stream 36 within the nozzle 10, the linear distance over which the coolant stream 36 maintains its laminar flow characteristics once it exits the nozzle 10 is greatly enhanced.

Figure 3:
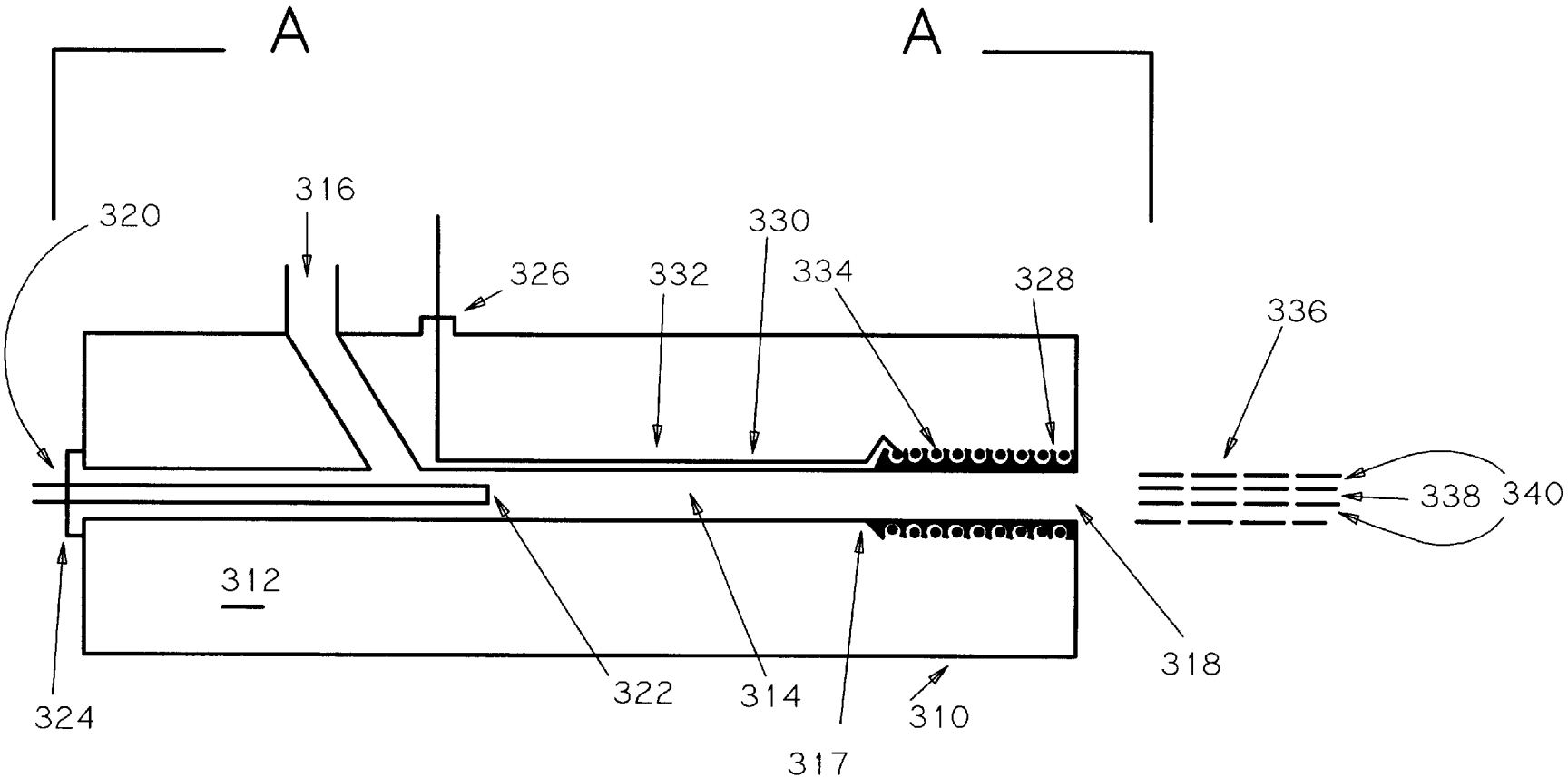
FIG. 3 is a cross-sectional view of an alternative embodiment of the coolant stream nozzle of FIG. 1, sectioned corresponding to plane A—A of FIG. 1.

Referring to FIG. 3, an alternative section along plane A—A of FIG. 1 is shown. In this embodiment, A nozzle 310 comprises an essentially cylindrical vacuum jacket 312 and a tubular cavity 314. Although not required, the tubular cavity may extend longitudinally down the entire nozzle 310 to provide an orifice 320, into which a measuring device, such as a thermocouple 322 may be inserted. In such cases, a seal 324 is provided to close the orifice 320 and prevent loss of material from the coolant stream 336 through the orifice 320.

The tubular cavity also comprises an inlet 316 and an outlet 318, through which the coolant stream 336 enters and exits, respectively, the tubular cavity 314. The outer surface 317 of the tubular cavity 314 comprises a scalloped heater seat 328, which provides a continuous groove into which a heater 330 may be threaded and seated. The scalloped form of the scalloped heater seat 328 allows the heater 330 to be placed in maximum physical contact with the tubular cavity 314 to maximize the heat transfer from the heater 330 to the tubular cavity 314.

The heater 330 comprises an active heater element 334 and a heater lead wire 332. The heater lead wire 332 provides an electrical connection to the active heater element 334, but does not itself produce significant heat while carrying current. This feature allows the heater lead wire 332 to be extended within the vacuum jacket to a convenient location where it can be connected to an external power source (not shown) via a vacuum feed through 326. Because the heater lead wire 332 does not produce significant heat, it does not adversely affect the conditions of the coolant stream 336 within the tubular cavity 314.

With the heater 330 turned on, the coolant stream 336 is heated in the region near the outlet 318, resulting in the coolant stream having an essentially hollow cylindrical, relatively warm outer zone 340 and an essentially cylindrical very cold inner zone 338. This embodiment differs from that of FIG. 1 by the absence of a flared zone in the tubular cavity 314, so that expansion of the relatively warm outer zone 340 of the coolant stream 336 would be expected to occur at a faster rate once the coolant stream exits the outlet 318 than would be the case in the preferred embodiment of FIGS. 1, 1A, and 1B.

Those of skill in the art will recognize that variations of the above description may be made without departing from the scope and spirit of this invention, and this invention shall not be unduly limited to these illustrative embodiments.

I claim:

1. A nozzle for delivering a coolant stream to a location within an ambient atmosphere, comprising a vacuum jacket, a tubular cavity set primarily within said vacuum jacket, comprising an inlet, an outlet, and an outer surface, and a heater within said vacuum jacket, wherein said heater is in conductive thermal contact with said outer surface of said tubular cavity.

2. The nozzle of claim 1, wherein said heater comprises a heater lead wire and an active heater wire, and said heater lead wire provides electrical current to said active heater wire.

3. The nozzle of claim 2, wherein said heater lead wire does not transfer significant heat to said tubular cavity.

4. The nozzle of claim 2, wherein said heater lead wire is not in thermal contact with said tubular cavity.

5. The nozzle of claim 1, wherein said tubular cavity is flared near said outlet.

6. The nozzle of claim 5, wherein said flare in said tubular cavity forms an essentially conical shape.

7. The nozzle of claim 1, additionally comprising a scalloped seat in thermal contact with said tubular cavity, and wherein said heater is in thermal contact with said scalloped seat.

8. The nozzle of claim 1, wherein the thermal contact between said tubular cavity and said heater is restricted to the region of said tubular cavity nearest said outlet.

9. The nozzle of claim 2, wherein said tubular cavity is flared near said outlet.

10. The nozzle of claim 9, wherein said flare in said tubular cavity forms an essentially conical shape.

11. The nozzle of claim 2, additionally comprising a scalloped seat in thermal contact with said tubular cavity, and wherein said active heater wire is in thermal contact with said scalloped seat.

12. The nozzle of claim 2, wherein the thermal contact between said tubular cavity and said heater is restricted to the region of said tubular cavity nearest said outlet.

13. A method of delivering a coolant stream to a location within an ambient atmosphere, comprising the steps of directing a coolant stream into the inlet of a tubular cavity, wherein said tubular cavity comprises an inlet and an outlet, and wherein said tubular cavity is primarily enclosed by a vacuum jacket, orienting said tubular cavity to direct the coolant stream exigent from said outlet of said tubular cavity at the desired location within the ambient atmosphere, and heating the outer zone of said coolant stream within said tubular cavity and near said outlet of said tubular cavity.

14. The method of claim 13, additionally comprising the step of providing a flared section in said tubular cavity adjacent said outlet of said tubular cavity.

15. The method of claim 14, additionally comprising the step of making said flared section in said tubular cavity essentially conical.

16. The method of claim 14, additionally comprising the step of restricting the heating of said coolant stream to said flared section in said tubular cavity.

* * * * *